US012305401B2

(12) United States Patent
Michael

(10) Patent No.: US 12,305,401 B2
(45) Date of Patent: May 20, 2025

(54) SELF-HEALING IMPACT RESISTANT ROOFING MATERIALS AND METHODS OF MAKING THEREOF

(71) Applicant: BMIC LLC, Dallas, TX (US)

(72) Inventor: Matthew Michael, Minneapolis, MN (US)

(73) Assignee: BMIC LLC, Dallas, TX (US)

( * ) Notice: Subject to any disclaimer, the term of this patent is extended or adjusted under 35 U.S.C. 154(b) by 0 days.

(21) Appl. No.: 18/371,644

(22) Filed: Sep. 22, 2023

(65) Prior Publication Data

US 2024/0102289 A1 Mar. 28, 2024

Related U.S. Application Data

(60) Provisional application No. 63/409,870, filed on Sep. 26, 2022.

(51) Int. Cl.

| | |
|---|---|
| ***E04D 5/12*** | (2006.01) |
| ***D06N 3/00*** | (2006.01) |
| ***D06N 5/00*** | (2006.01) |
| ***E04D 1/00*** | (2006.01) |
| ***E04D 1/28*** | (2006.01) |

(52) U.S. Cl.

CPC ..... *E04D 5/12* (2013.01); *D06N 3/0002* (2013.01); *D06N 5/00* (2013.01); *E04D 1/28* (2013.01); *D06N 2201/02* (2013.01); *D06N 2201/082* (2013.01); *D06N 2205/10* (2013.01); *E04D 2001/005* (2013.01)

(58) Field of Classification Search

CPC ..... E04D 5/12; E04D 1/28; E04D 2001/005; D06N 3/0002; D06N 5/00; D06N 2201/02; D06N 2201/082; D06N 2205/10

See application file for complete search history.

(56) References Cited

U.S. PATENT DOCUMENTS

| | | | | |
|---|---|---|---|---|
| 8,852,680 | B2 | 10/2014 | Shiao et al. | |
| 11,131,597 | B1 | 9/2021 | Oakes, III et al. | |
| 11,396,604 | B1 | 7/2022 | Barton et al. | |
| 2004/0014385 | A1* | 1/2004 | Greaves, Jr. | E04D 5/12 442/364 |
| 2008/0248246 | A1* | 10/2008 | Shiao | E04D 5/12 428/147 |
| 2009/0035557 | A1* | 2/2009 | Hartmann | F28D 20/023 428/323 |
| 2009/0220743 | A1* | 9/2009 | Aschenbeck | E04D 5/12 428/221 |
| 2020/0216722 | A1 | 7/2020 | Wilfried et al. | |
| 2021/0324241 | A1 | 10/2021 | Carl et al. | |
| 2022/0339913 | A1 | 10/2022 | Xu et al. | |

* cited by examiner

*Primary Examiner* — Nathan L Van Sell

(74) *Attorney, Agent, or Firm* — Venable LLP

(57) ABSTRACT

This invention, in embodiments, relates to a roofing material comprising (a) a substrate having a top surface and a back surface, (b) a plurality of self-healing particles embedded into the substrate, and (c) a coating applied onto the substrate having the plurality of self-healing particles embedded therein, to provide a coated substrate. The plurality of self-healing particles can be embedded into the top surface and/or the back surface of the substrate. The roofing material can further include a plurality of roofing granules applied to a top surface of the coating of the coated substrate. This invention, in embodiments, further relates to a method of preparing such a roofing material.

8 Claims, 4 Drawing Sheets

Table 5.1
Drop height and kinetic energy

| Class | Steel ball diameter | | Distance | | Kinetic energy | |
|---|---|---|---|---|---|---|
| | Inches | (mm) | Feet | (m) | ft-lbf | (J) |
| 1 | 1-1/4 | (31.8) | 12.0 | (3.7) | 3.53 | (4.78) |
| 2 | 1-1/2 | (38.1) | 15.0 | (4.6) | 7.35 | (9.95) |
| 3 | 1-3/4 | (44.5) | 17.0 | (5.2) | 13.56 | (18.37) |
| 4 | 2 | (50.8) | 20.0 | (6.1) | 23.71 | (32.12) |

*FIG. 5*

SELF-HEALING IMPACT RESISTANT ROOFING MATERIALS AND METHODS OF MAKING THEREOF

This application claims the priority of U.S. provisional application Ser. No. 63/409,870 entitled "Self-Healing Impact Resistant Roofing Materials and Methods of Making Thereof" filed Sep. 26, 2022, which is incorporated herein by reference in its entirety for all purposes.

FIELD OF THE INVENTION

This invention relates to self-healing impact resistant roofing materials and methods of making these roofing materials. By preparing roofing materials such as, e.g., shingles, having embedded particles that include micro-encapsulated healing agents, these roofing materials can exhibit self-healing properties with improved impact resistance, as compared to roofing materials not prepared with such embedded particles.

BACKGROUND OF THE INVENTION

Traditional roofing materials, such as, e.g., shingles, are based upon a glass or felt mat that is coated and impregnated with an asphalt-based composition that is coated with granules. As shingles or roofing membranes are exposed to outdoor environments, these roofing materials may suffer from cracking or puncture damage due to impact forces, particularly those arising from hailstorms.

There is thus a need for self-healing impact resistant roofing materials that exhibit self-healing properties with improved impact resistance when subjected to various impact forces, including those arising from hailstorms.

SUMMARY OF THE INVENTION

One embodiment of this invention pertains to a roofing material comprising (a) a substrate having a top surface and a back surface, (b) a plurality of self-healing particles embedded into the top surface of the substrate, and (c) a coating applied onto the top surface of the substrate having the plurality of self-healing particles embedded therein, to provide a coated substrate.

In one embodiment, the roofing material further includes a plurality of roofing granules applied to a top surface of the coating of the coated substrate.

In one embodiment, the coating comprises one of an asphaltic coating, a non-asphaltic coating, a polymer-modified asphaltic coating, or a combination thereof.

In one embodiment, the substrate comprises one of a fiberglass mat, a polyester mat, a scrim, a coated scrim, or a combination thereof.

In one embodiment, the self-healing particles comprise an external shell and a film-forming material within the external shell. In another embodiment, the self-healing particles further comprise one or more additives.

In one embodiment, the roofing material having the plurality of self-healing particles achieves at least a Class 3 rating for impact resistance according to UL 2218.

In one embodiment, the roofing material having the plurality of self-healing particles achieves a Class 4 rating for impact resistance according to UL 2218.

In one embodiment, the roofing material is one of a roofing shingle, a roofing membrane, and a roofing tile.

In one embodiment, the roofing material is one of (i) an asphaltic shingle, (ii) a non-asphaltic shingle, and (ii) a polymer-modified asphalt shingle.

In one embodiment, the roofing material exhibits an improved impact resistance as compared to a roofing material prepared without self-healing particles.

Another embodiment of this invention pertains to a roofing material comprising (a) a substrate having a top surface and a back surface, (b) a plurality of self-healing particles embedded into the substrate, and (c) a coating applied onto the substrate having the plurality of self-healing particles embedded therein, to provide a coated substrate.

In one embodiment, the plurality of self-healing particles is embedded into the top surface of the substrate.

In one embodiment, the plurality of self-healing particles is embedded into the back surface of the substrate.

In one embodiment, the roofing material further includes a plurality of roofing granules applied to a top surface of the coating of the coated substrate.

In one embodiment, the coating comprises one of an asphaltic coating, a non-asphaltic coating, a polymer-modified asphaltic coating, or a combination thereof.

In one embodiment, the substrate comprises one of a fiberglass mat, a polyester mat, a scrim, a coated scrim, or a combination thereof.

In one embodiment, the self-healing particles comprise an external shell and a film-forming material within the external shell. In another embodiment, the self-healing particles further comprise one or more additives.

Another embodiment of this invention pertains to a method of preparing a roofing material. The method includes (a) obtaining a substrate having a top surface and a back surface, (b) obtaining a plurality of self-healing particles, (c) applying the plurality of self-healing particles to the top surface of the substrate to embed the plurality of self-healing particles therein, and (d) applying a coating to the top surface of the substrate having the plurality of self-healing particles embedded therein, to provide a coated substrate.

In one embodiment, the method further includes applying a plurality of roofing granules to a top surface of the coated substrate to form the roofing material.

In one embodiment, the step of applying the plurality of self-healing particles to the top surface of the substrate is conducted via spraying the plurality of self-healing particles onto the top surface of the substrate.

In one embodiment, the step of applying the plurality of self-healing particles to the top surface of the substrate is conducted to achieve an even distribution of self-healing particles across the top surface of the substrate.

In one embodiment, the step of applying the plurality of self-healing particles to the top surface of the substrate is conducted to achieve an average surface coverage amount of the plurality of self-healing particles of greater than 50%. In one embodiment, the step of applying the plurality of self-healing particles to the top surface of the substrate is conducted to achieve an average surface coverage amount of the plurality of self-healing particles of about 100%.

In one embodiment, the coating comprises one of an asphaltic coating, a non-asphaltic coating, a polymer-modified asphaltic coating, or a combination thereof.

In one embodiment, the substrate comprises one of a fiberglass mat, a polyester mat, a scrim, a coated scrim, or a combination thereof.

In one embodiment, the self-healing particles comprise an external shell and a film-forming material within the external shell. In another embodiment, the self-healing particles further comprise one or more additives.

In some embodiments, the roofing material is one of a roofing shingle, a roofing membrane, and a roofing tile.

Another embodiment of this invention pertains to a method of preparing a roofing material. The method includes (a) obtaining a substrate having a top surface and a back surface, (b) obtaining a plurality of self-healing particles, (c) applying the plurality of self-healing particles to the substrate to embed the plurality of self-healing particles therein, and (d) applying a coating to the substrate having the plurality of self-healing particles embedded therein, to provide a coated substrate.

In one embodiment, the plurality of self-healing particles is applied to the top surface of the substrate.

In one embodiment, the plurality of self-healing particles is applied to the back surface of the substrate.

In one embodiment, the method further includes applying a plurality of roofing granules to a top surface of the coated substrate to form the roofing material.

BRIEF DESCRIPTION OF THE FIGURES

For a more complete understanding of the invention and the advantages thereof, reference is made to the following descriptions, taken in conjunction with the accompanying figures, in which:

FIG. 5 is a Table that illustrates the Class ratings for impact resistance of a roofing material according UL 2218.

DETAILED DESCRIPTION OF THE INVENTION

Figure 1:
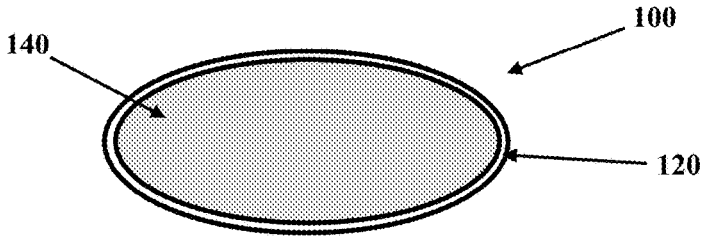
FIG. 1 is an illustration of a self-healing particle according to an embodiment of the invention.

Among those benefits and improvements that have been disclosed, other objects and advantages of this disclosure will become apparent from the following description taken in conjunction with the accompanying figures. Detailed embodiments of the present disclosure are disclosed herein; however, it is to be understood that the disclosed embodiments are merely illustrative of the disclosure that may be embodied in various forms. In addition, each of the examples given regarding the various embodiments of the disclosure are intended to be illustrative, and not restrictive.

Throughout the specification and claims, the following terms take the meanings explicitly associated herein, unless the context clearly dictates otherwise. The phrases "in one embodiment," "in an embodiment," and "in some embodiments" as used herein do not necessarily refer to the same embodiment(s), though they may. Furthermore, the phrases "in another embodiment" and "in some other embodiments" as used herein do not necessarily refer to a different embodiment, although they may. All embodiments of the disclosure are intended to be combinable without departing from the scope or spirit of the disclosure.

As used herein, the term "based on" is not exclusive and allows for being based on additional factors not described, unless the context clearly dictates otherwise. In addition, throughout the specification, the meaning of "a," "an," and "the" include plural references. The meaning of "in" includes "in" and "on."

As used herein, terms such as "comprising," "including," and "having" do not limit the scope of a specific claim to the materials or steps recited by the claim.

As used herein, terms such as "consisting of" and "composed of" limit the scope of a specific claim to the materials and steps recited by the claim.

All prior patents, publications, and test methods referenced herein are incorporated by reference in their entireties.

As used herein, the term "coated substrate" means a substrate that is coated on one side (upper surface or lower surface, or otherwise referred to as top surface or back surface, respectively) or both sides (upper surface and lower surface, or otherwise referred to as top surface and back surface, respectively) with a coating that includes, for example, an asphaltic coating, a non-asphaltic coating, and/or a polymer-modified asphalt coating. According to one embodiment, the "coated substrate" can also include a modified bitumen roll(s) or a roll(s) of non-asphaltic roofing.

As used herein, the term "weight percent" or "% by weight" means the percentage by weight of the self-healing particles based upon a total weight of the self-healing particles applied to the roofing material.

As used herein, the term "a majority of" means greater than 50% by weight.

As used herein, the term "roofing material" includes, but is not limited to, shingles, roofing membranes, including, e.g., waterproofing membranes, underlayment, and tiles.

As used herein, the term "embed" or "embedded" means the particles are (i) attached and/or affixed to a top surface of a substrate, (ii) attached and/or affixed to a bottom surface of a substrate, (iii) attached and/or affixed within the internal portion (including, e.g., within the interstices) of a substrate, or (iv) a combination thereof.

As used herein, the terms "Class 1 rating," "Class 2 rating," "Class 3 rating," and "Class 4 rating" relate to the ratings achieved by roofing materials according to the UL 2218 Standard for Safety with respect to "Impact Resistance of Prepared Roof Covering Materials."

As used herein, the rating of roofing materials for impact resistance according to UL 2218 is conducted on roofing materials prepared according to ASTM D-3462 (Standard Specification for Asphalt Shingles Made from Glass Felt and Surfaced with Mineral Granules).

One embodiment of this invention pertains to a roofing material comprising (a) a substrate having a top surface and a back surface, (b) a plurality of self-healing particles embedded into the top surface of the substrate, and (c) a coating applied onto the top surface of the substrate having the plurality of self-healing particles embedded therein, to provide a coated substrate.

FIG. 1 illustrates a self-healing particle 100 according to an embodiment of the invention. In this embodiment, the self-healing particle 100 includes an external shell 120 and a film-forming material 140 within the external shell 120. The self-healing particle(s) 100 can reduce or eliminate damage to shingles or roofing membranes caused by impact forces, such as, e.g., cracking or puncture damage due to impact forces, particularly those arising from hailstorms. The self-healing particle(s) 100 is capable of rupturing upon impact and dispensing the film-forming material 140 to help repair the damage to the shingles or roofing membranes. The external shell 120 of the self-healing particle 100 has enough strength to endure the manufacturing operation of shingle making and normal foot traffic without rupture, and yet is weak enough to be easily broken upon impact of impactful and/or sizable hail stones. However, in order for the external shell 120 of the self-healing particle 100 to rupture, an impact force, such as, e.g., an impactful hail stone, needs to be large enough to impact the substrate or mat containing the self-healing particle(s), as discussed further below.

According to one embodiment, the external shell 120 comprises a material such as, e.g., glass, ceramics, or polymers that are durable and inert toward the encapsulated film-forming material 140, yet capable of rupturing upon a sizable impact force, such as, e.g., an impactful hail stone.

According to one embodiment, the film-forming material 140 comprises adhesives, adhesion promoters, coatings, asphalt-based coatings or emulsions, non-asphaltic-based coatings or emulsions, polymer-modified-asphalt-based coatings or emulsions, plasticizers, or a mixture thereof, to mend cracks or puncture damage due to impact forces, particularly those arising from hailstorms.

According to an embodiment, the self-healing particle 100 and/or the film-forming material 140 further comprises one or more additives. According to one embodiment, the additives comprise pigments to enhance appearance or solar reflectance, biocides to control undesirable fungi or algae growth, or combinations thereof.

In another embodiment, the self-healing particles can contain functional fillers to improve processability, fire resistance, UV resistance, UV blocking, oxidation resistance, color stability, and combinations thereof, as well as fillers able to remove and/or trap a targeted chemical compound (such as, e.g., NOx, $CO_2$, etc.). Also, according to an embodiment, the self-healing particles can have highly reflective pigments, such as, e.g., pigments comprising $TiO_2$, metal oxides, graphene, perylene, transitional metal oxides, metallic pigments, pearlescent pigments, thin film coated pigments, solar reflective colorants, solar reflective fillers, opacifiers, voids, or their combinations.

According to one embodiment, the self-healing particles have an average size of from about 1 micrometer to 1000 micrometers. According to one embodiment, the self-healing particles have an average size of from about 50 micrometers to 1000 micrometers. According to one embodiment, the self-healing particles have an average size of from about 50 micrometers to 500 micrometers According to another embodiment, the self-healing particles have an average size of from about 50 micrometers to 300 micrometers. According to one embodiment, the self-healing particles have an average size of from about 50 micrometers to 100 micrometers. According to one embodiment, the self-healing particles have an average size of from about 100 micrometers to 1000 micrometers. According to one embodiment, the self-healing particles have an average size of from about 100 micrometers to 500 micrometers According to another embodiment, the self-healing particles have an average size of from about 100 micrometers to 300 micrometers. According to an embodiment, the self-healing particles are the size of a sand particle.

Figure 2A:
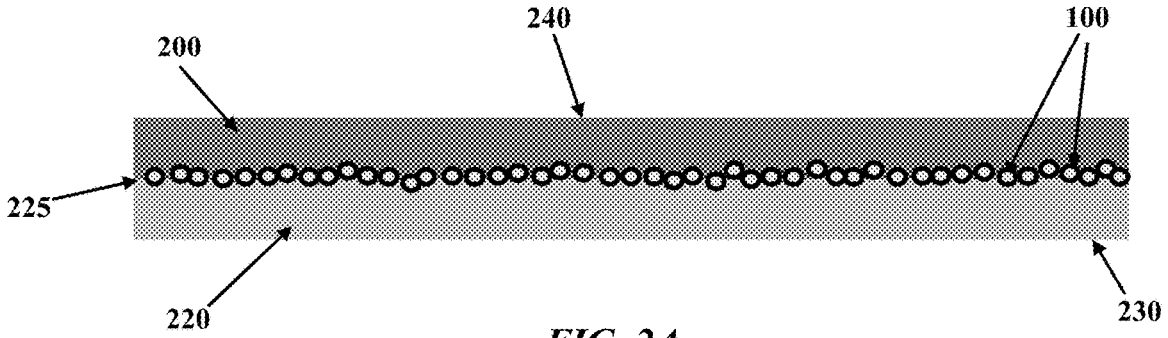
FIG. 2A is an illustration of a roofing material having a plurality of self-healing particles according to an embodiment of the invention.

FIG. 2A illustrates a roofing material (e.g., shingle, coated substrate, or roofing membrane) 200 according to an embodiment of the invention. In this embodiment, the roofing material 200 includes a substrate 220 having a front or top surface 225 and a back surface 230. The roofing material 200 further includes a plurality of self-healing particles 100 (such as those discussed above with respect to FIG. 1) embedded into the top surface 225 of the substrate 220. According to another embodiment (not shown), the roofing material 200 could include the plurality of self-healing particles 100 embedded into the back surface 230 of the substrate 220. The roofing material 200 also includes a coating 240, such as, e.g., an asphaltic coating, a non-asphaltic coating, a polymer-modified asphaltic coating, etc., applied onto the top surface 225 of the substrate 220 having the plurality of self-healing particles 100 embedded therein. According to one embodiment, the plurality of self-healing particles 100 are embedded within and/or attached to the top surface 225 of the substrate 220 via adherence, electrostatic attraction, or other means of embedding and/or attaching to a substrate. For example, according to one embodiment, the substrate 220 (such as, e.g., a fiberglass mat) is porous, even after curing, such that upon applying the plurality of self-healing particles 100 to the top surface 225 of the substrate, the plurality of self-healing particles 100 become attached and/or embedded to the top surface 225 of the substrate and/or attached and/or embedded within the pores (or interstices) of the substrate 220.

Figure 2B:
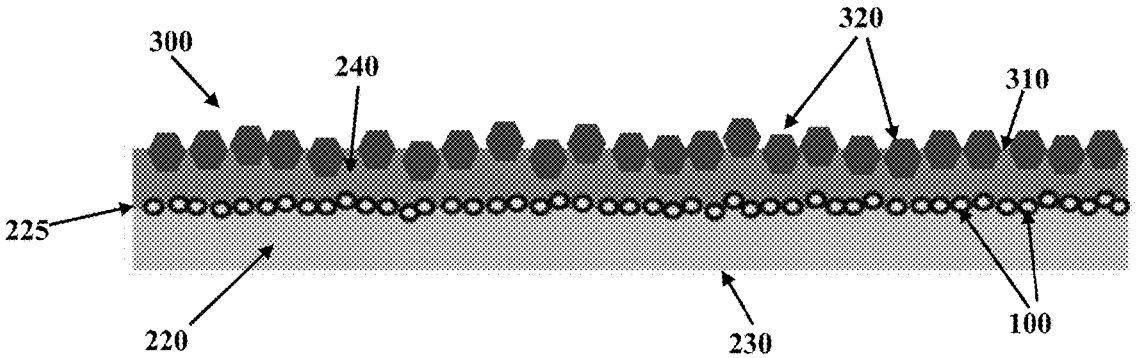
FIG. 2B is an illustration of a roofing material having a plurality of self-healing particles and a plurality of roofing granules according to an embodiment of the invention.

FIG. 2B illustrates a roofing material (e.g., shingle) 300 in which the roofing material 200 of FIG. 2A further includes a plurality of roofing granules 320 disposed on a top surface 310 of the coating 240. Thus, as illustrated in this embodiment, the plurality of self-healing particles 100 are disposed on and/or embedded into the top surface 225 of the substrate 220, while the plurality of roofing granules 320 are disposed on and/or embedded into the top surface 310 of the coating 240.

In an embodiment, the substrate (e.g., substrate 220) comprises one of a fiberglass mat, a polyester mat, a scrim, a coated scrim, or a combination thereof. In some embodiments, the substrate or mat includes nano-fibrillated cellulose fibers.

In one embodiment, the coating comprises one of an asphaltic coating, a non-asphaltic coating, a polymer-modified asphaltic coating, or a combination thereof.

In an embodiment, the roofing material (e.g., roofing material 200 or 300) is one of a roofing shingle, a roofing membrane, and a roofing tile. In some embodiments, the roofing material is one of (i) an asphaltic shingle, (ii) a non-asphaltic shingle, and (ii) a polymer-modified asphalt shingle. According to one embodiment, the roofing material is a roofing shingle that is one of (i) a single layer shingle or (ii) a laminated shingle having two or more layers.

In an embodiment, the roofing material exhibits an improved impact resistance as compared to a roofing material prepared without self-healing particles.

According to an embodiment, a plurality of self-healing particles is embedded into a substrate that is then prepared into a roofing material according to ASTM D-3462. This roofing material prepared according to ASTM D-3462 and having the plurality of self-healing particles is thereafter rated for its impact resistance according to UL 2218. In one embodiment, the roofing material having the plurality of self-healing particles achieves at least a Class 3 rating for impact resistance according to UL 2218. In one embodiment, the roofing material having the plurality of self-healing particles achieves a Class 4 rating for impact resistance according to UL 2218. (See, e.g., FIG. 5.)

Another embodiment of this invention pertains to a roofing material comprising (a) a substrate having a top surface and a back surface, (b) a plurality of self-healing particles embedded into the substrate, and (c) a coating applied onto the substrate having the plurality of self-healing particles embedded therein, to provide a coated substrate.

In one embodiment, the plurality of self-healing particles is embedded into the top surface of the substrate. In another embodiment, the plurality of self-healing particles is embedded into the back surface of the substrate. In an embodiment, the plurality of self-healing particles is embedded into the top surface and/or the back surface of the substrate.

Another embodiment of this invention pertains to a method of preparing a roofing material. The method includes (a) obtaining a substrate having a top surface and a back surface, (b) obtaining a plurality of self-healing particles, (c) applying the plurality of self-healing particles to the top surface of the substrate to embed the plurality of self-healing particles therein, and (d) applying a coating to the top surface of the substrate having the plurality of self-healing particles embedded therein, to provide a coated substrate. In one embodiment, the method further includes applying a plurality of roofing granules to a top surface of the coated substrate to form the roofing material.

Figure 3A:
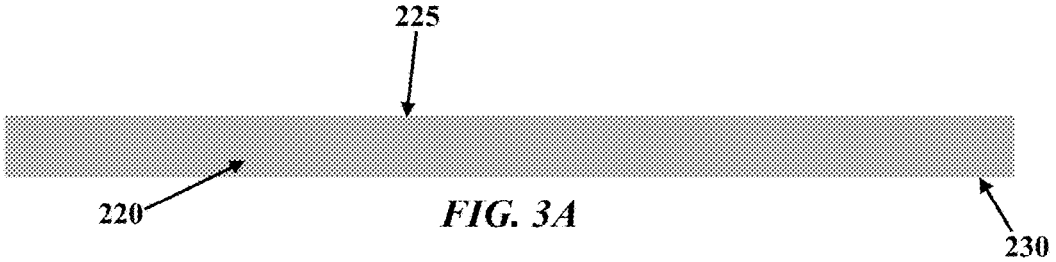
FIGS. 3A to 3D are illustrations of a method of preparing a roofing material having a plurality of self-healing particles according to an embodiment of the invention.
Figure 3B:
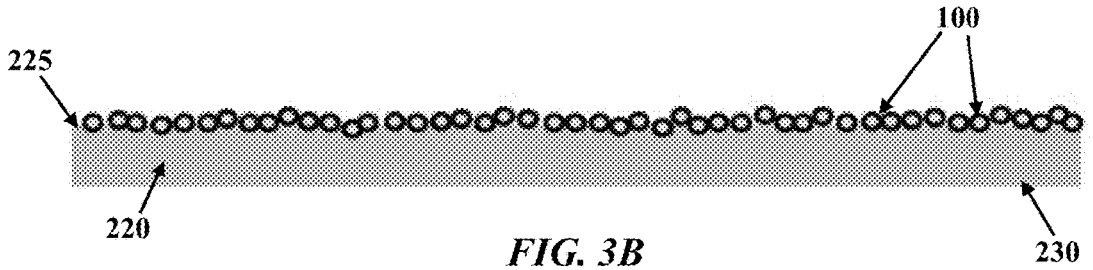
Figure 3C:
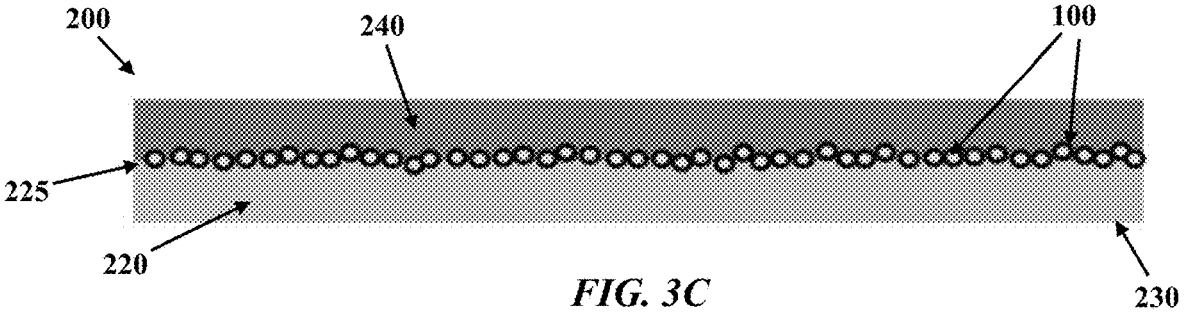
Figure 3D:
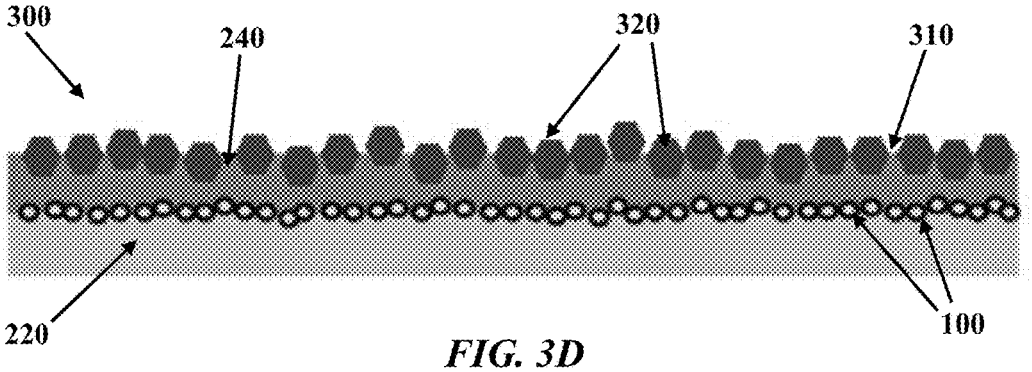

FIGS. 3A to 3D illustrate a method of preparing a roofing material having a plurality of self-healing particles according to an embodiment of the invention. As shown in FIG. 3A, in a first step, a substrate 220 having a front or top surface 225 and a back surface 230 is provided, obtained, and/or prepared. According to one embodiment, the substrate 220 comprises one of a fiberglass mat, a polyester mat, a scrim, a coated scrim, or a combination thereof. As shown in FIG. 3B, in a second step, a plurality of self-healing particles 100 are provided, obtained, and/or prepared, with the plurality of self-healing particles 100 being applied onto the top surface 225 of the substrate 220 to embed the plurality of self-healing particles 100 therein. As shown in FIG. 3C, in a third step, a coating 240 is applied to the top surface 225 of the substrate 220 having the plurality of self-healing particles 100 embedded therein, to provide a coated substrate and/or roofing material 200. According to one embodiment, the coating 240 comprises one of an asphaltic coating, a non-asphaltic coating, a polymer-modified asphaltic coating, or a combination thereof. As shown in FIG. 3D, in a fourth step, a plurality of roofing granules 320 are applied to a top surface 310 of the coating 240 (or coated substrate 200) to form a roofing material 300.

In one embodiment, the step of applying the plurality of self-healing particles 100 to the top surface 225 of the substrate 220 is conducted via spraying the plurality of self-healing particles 100 onto the top surface 225 of the substrate 220. For example, according to one embodiment, in manufacturing the roofing material 300, a continuous sheet of the substrate 220 is fed past one or more containers (not shown) containing the plurality of self-healing particles 100. The plurality of self-healing particles 100 is continuously applied (e.g., sprayed) onto the substrate 220 in order to embed the plurality of self-healing particles 100 into the top surface 225 of the substrate 220. Thereafter, the continuous sheet of the substrate 220 having the plurality of self-healing particles 100 embedded therein is fed through one or more tanks containing a molten coating composition (such as, e.g., an asphalt-based bituminous composition, a non-asphaltic-based composition, or a polymer-modified-asphalt-based composition) at an elevated temperature to coat and impregnate the substrate 220 with the coating composition (e.g., coating 240) in order to form the coated substrate or roofing material 200. While the coating composition (e.g., coating 240) is still warm and soft, roofing granules 320 are dropped onto at least a portion of a top surface 310 of the coating 240 (or coated substrate 200) and become partially embedded therein, thus forming a roofing material 300.

According to an embodiment, the self-healing particles can be applied onto the substrate and/or the roofing granules can be applied to a molten coating composition (such as, e.g., an asphalt-based bituminous composition, a non-asphaltic-based composition, or a polymer-modified-asphalt-based composition) in a moving web via gravity feed, or another system, including, e.g., a high-speed granule or particle system which does not rely on gravity to apply the particles and/or granules during a shingle manufacturing process to obtain shingles with a lighter weight. According to another embodiment, the self-healing particles can be applied onto the substrate and/or the roofing granules can be applied to a molten coating composition (such as, e.g., an asphalt-based bituminous composition, a non-asphaltic-based composition, or a polymer-modified-asphalt-based composition) via equipment that is designed to apply particles onto a moving web in a precise manner, such as, e.g., a high-speed particle applicator, electrostatic deposition, particle spraying, and combinations thereof.

According to an embodiment, the self-healing particles and the roofing granules are applied in two separate or independent steps. According to an embodiment, the self-healing particles and the roofing granules are applied in two separate or independent plants. According to an embodiment, the self-healing particles and the roofing granules are applied via two separate and/or different methods. According to one embodiment, the self-healing particles are sprayed with an adhesive compound in order for the self-healing particles to attach to the top surface of the substrate. The roofing granules are applied, in a separate step, to the top surface of the substrate via gravity feed or by being dropped onto the molten coating composition (such as, e.g., an asphalt-based bituminous composition, a non-asphaltic-based composition, or a polymer-modified-asphalt-based composition) that forms the surface coating.

In one embodiment, the step of applying the plurality of self-healing particles to the top surface of the substrate is conducted to achieve an even distribution of self-healing particles across the top surface of the substrate.

In one embodiment, the step of applying the plurality of self-healing particles to the top surface of the substrate is conducted to achieve an average surface coverage amount of the self-healing particles of 100%. In one embodiment, the step of applying the plurality of self-healing particles to the top surface of the substrate is conducted to achieve an average surface coverage amount of the self-healing particles of greater than 95%. In an embodiment, the step of applying the plurality of self-healing particles to the top surface of the substrate is conducted to achieve an average surface coverage amount of the self-healing particles of greater than 90%. In an embodiment, the step of applying the plurality of self-healing particles to the top surface of the substrate is conducted to achieve an average surface coverage amount of the self-healing particles of greater than 85%. In an embodiment, the step of applying the plurality of self-healing particles to the top surface of the substrate is conducted to achieve an average surface coverage amount of the self-healing particles of greater than 80%. In an embodiment, the step of applying the plurality of self-healing particles to the top surface of the substrate is conducted to achieve an average surface coverage amount of the self-healing particles of greater than 75%. In an embodiment, the step of applying the plurality of self-healing particles to the top surface of the substrate is conducted to achieve an average surface coverage amount of the self-healing particles of greater than 70%. In an embodiment, the step of applying the plurality of self-healing particles to the top surface of the substrate is conducted to achieve an average surface coverage amount of the self-healing particles of greater than 65%. In an embodiment, the step of applying the plurality of self-healing particles to the top surface of the substrate is conducted to achieve an average surface coverage amount of the self-healing particles of greater than 60%. In an embodiment, the step of applying the plurality of self-healing particles to the top surface of the substrate is conducted to achieve an average surface coverage amount of the self-healing particles of greater than 55%. In an embodiment, the step of applying the plurality of self-healing particles to the top surface of the substrate is conducted to achieve an average surface coverage amount of the self-healing particles of greater than 50%.

In an embodiment, the step of applying the plurality of self-healing particles to the top surface of the substrate is conducted to achieve an average surface coverage amount of the self-healing particles of between 50% and 100%. In an embodiment, the step of applying the plurality of self-healing particles to the top surface of the substrate is conducted to achieve an average surface coverage amount of the self-healing particles of between 60% and 100%. In an embodiment, the step of applying the plurality of self-healing particles to the top surface of the substrate is conducted to achieve an average surface coverage amount of the self-healing particles of between 70% and 100%. In an embodiment, the step of applying the plurality of self-healing particles to the top surface of the substrate is conducted to achieve an average surface coverage amount of the self-healing particles of between 80% and 100%. In an embodiment, the step of applying the plurality of self-healing particles to the top surface of the substrate is conducted to achieve an average surface coverage amount of the self-healing particles of between 90% and 100%. In an embodiment, the step of applying the plurality of self-healing particles to the top surface of the substrate is conducted to achieve an average surface coverage amount of the self-healing particles of between 50% and 90%. In an embodiment, the step of applying the plurality of self-healing particles to the top surface of the substrate is conducted to achieve an average surface coverage amount of the self-healing particles of between 60% and 90%. In an embodiment, the step of applying the plurality of self-healing particles to the top surface of the substrate is conducted to achieve an average surface coverage amount of the self-healing particles of between 70% and 90%. In an embodiment, the step of applying the plurality of self-healing particles to the top surface of the substrate is conducted to achieve an average surface coverage amount of the self-healing particles of between 80% and 90%. In an embodiment, the step of applying the plurality of self-healing particles to the top surface of the substrate is conducted to achieve an average surface coverage amount of the self-healing particles of between 50% and 80%. In an embodiment, the step of applying the plurality of self-healing particles to the top surface of the substrate is conducted to achieve an average surface coverage amount of the self-healing particles of between 60% and 80%. In an embodiment, the step of applying the plurality of self-healing particles to the top surface of the substrate is conducted to achieve an average surface coverage amount of the self-healing particles of between 70% and 80%. In an embodiment, the step of applying the plurality of self-healing particles to the top surface of the substrate is conducted to achieve an average surface coverage amount of the self-healing particles of between 50% and 70%. In an embodiment, the step of applying the plurality of self-healing particles to the top surface of the substrate is conducted to achieve an average surface coverage amount of the self-healing particles of between 60% and 70%. In an embodiment, the step of applying the plurality of self-healing particles to the top surface of the substrate is conducted to achieve an average surface coverage amount of the self-healing particles of between 50% and 60%.

Another embodiment of this invention pertains to a method of preparing a roofing material. The method includes (a) obtaining a substrate having a top surface and a back surface, (b) obtaining a plurality of self-healing particles, (c) applying the plurality of self-healing particles to the substrate to embed the plurality of self-healing particles therein, and (d) applying a coating to the substrate having the plurality of self-healing particles embedded therein, to provide a coated substrate.

In one embodiment, the plurality of self-healing particles is applied to the top surface of the substrate. In another embodiment, the plurality of self-healing particles is applied to the back surface of the substrate. In an embodiment, the plurality of self-healing particles is applied to the top surface and/or the back surface of the substrate.

Figure 4A:
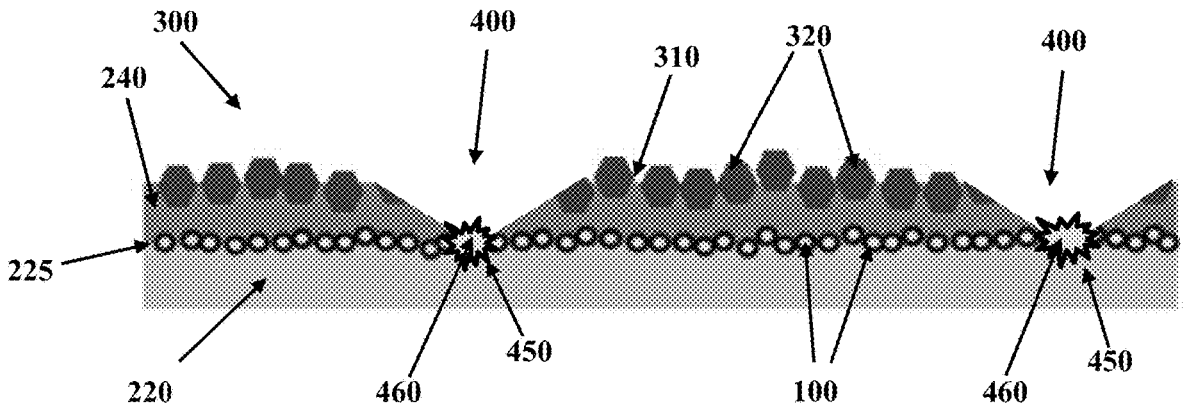
FIG. 4A is an illustration of a roofing material having a plurality of self-healing particles in which the roofing material has been subjected to impact forces that form cracks within the roofing material according to an embodiment of the invention.
Figure 4B:
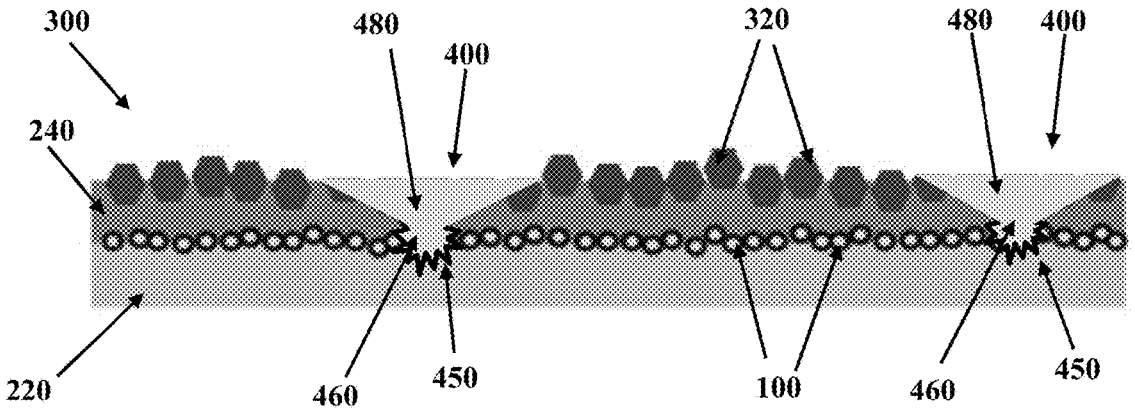
FIG. 4B is an illustration of the roofing material of FIG. 4A in which the cracks have been filled via the self-healing particles according to an embodiment of the invention.

FIGS. 4A and 4B illustrate a roofing material 300 having a plurality of self-healing particles 100 in which the roofing material 300 has been subjected to impact forces that form cracks within the roofing material 300 according to an embodiment of the invention. For example, as shown in FIG. 4A, the roofing material 300 (as described above) has sustained mechanical damage in the form of a pair of cracks 400 after being impacted by an impactful hail stone (not shown) (such as, e.g., a hail stone that has a higher kinetic energy than a Class 4 rating test for the impact resistance of a roofing material according to UL 2218 (see, e.g., FIG. 5)). Each of the cracks 400 extend from the top surface 310 of the coating 240 to the top surface 225 of the substrate 220 having the plurality of self-healing particles 100 embedded therein. The impact from the hail stone has ruptured several of the self-healing particles 100 (see, e.g., ruptured self-healing particles 450), which comprise, when intact, an external shell filled with a film-forming material 460 (see also, e.g., FIG. 1). As shown in FIGS. 4A and 4B, the ruptured self-healing particles 450 include the film-forming composition 460, which has flowed (in FIG. 4B) from the ruptured self-healing particles 450 into the cracks 400 to form a liquid or film layer covering the cracks 400, with the liquid or film layer being subsequently cured to provide a protective film 480 over the cracks 400, thus "healing" the cracks 400.

As discussed above, the self-healing particles, which comprise an external shell filled with a film-forming material, are capable of rupturing upon impact and dispensing the film-forming material to help repair the damage to the shingles or roofing membranes. The external shell of the self-healing particles has enough strength to endure the manufacturing operation of shingle making and normal foot traffic without rupture, and yet is weak enough to be easily broken upon impact of a sizable impact force (e.g., an impactful hail stone(s)). However, in order for the external shell of the self-healing particles to rupture, an impact force, such as, e.g., an impactful and/or a sizable hail stone, needs to be large enough to impact the substrate or mat containing the self-healing particles (such as, e.g., a hail stone that has a higher kinetic energy than a Class 4 rating test for the impact resistance of a roofing material according to UL 2218

(see, e.g., FIG. 5)). For example, an impact force, such as, e.g., a hailstorm, will not rupture the self-healing particles of the substrate if only the coating and/or the granules of the roofing material is impacted by the force (see, e.g., coating 240 of FIGS. 2A and 2B). Thus, an impact force, such as, e.g., a hailstorm, will only rupture the self-healing particles if the substrate or mat itself is exposed to the impact force (or hailstorm). Such features of the disclosed roofing material are beneficial because the self-healing particles will not rupture unless there is a large enough impact force (e.g., hailstorm) that penetrates into the substrate (e.g., fiberglass mat) itself. This prevents pre-mature rupture of the self-healing particles due to other, less minor impact forces (e.g., minor hailstorms, foot traffic, falling tree branches, etc.).

According to an embodiment, the film-forming material or self-healing compound that is provided within an external shell of the self-healing particles cures upon exposure to air and/or UV. In that case, if the self-healing particles rupture after being covered by the coating (e.g., asphalt or polymer-modified asphalt) applied to the top surface of the substrate, exposure to air and/or UV would be prevented until such time that a hail stone or another cause cracks the coating and exposes the substrate to air and/or UV. According to this embodiment, an added benefit is that if the manufacturing process or other impact force causes the self-healing particle to prematurely rupture, the film-forming material or self-healing compound would still be available in the event of a more severe crack.

Although the embodiments discussed above for the roofing material and/or the method of preparing a roofing material generally provide the plurality of self-healing particles (such as those discussed above with respect to FIG. 1) embedded into a top surface of a substrate, with the plurality of self-healing particles being embedded within and/or attached to the top surface of the substrate, the plurality of self-healing particles can also be embedded within and/or attached to a bottom or back surface of a substrate (see, e.g., back surface 230 of substrate 220 of FIG. 2A), embedded within the substrate itself, and/or a combination thereof. According to an embodiment, the embedding of the plurality of self-healing particles into the substrate (e.g., the top surface, back surface, and/or within the substrate) can occur via adherence, electrostatic attraction, or other means of embedding and/or attaching to a substrate.

Although the invention has been described in certain specific exemplary embodiments, many additional modifications and variations would be apparent to those skilled in the art in light of this disclosure. It is, therefore, to be understood that this invention may be practiced otherwise than as specifically described. Thus, the exemplary embodiments of the invention should be considered in all respects to be illustrative and not restrictive, and the scope of the invention to be determined by any claims supportable by this application and the equivalents thereof, rather than by the foregoing description.

I claim:

1. A roofing material comprising:

(a) a substrate having a top surface and a back surface, the substrate being uncoated and comprising one of a fiberglass mat, a polyester mat, a scrim, or a combination thereof;

(b) a plurality of self-healing particles embedded into the top surface of the uncoated substrate, such that the plurality of self-healing particles directly contact the top surface of the uncoated substrate, wherein each self-healing particle of the plurality of self-healing particles comprises an external shell and a film-forming material within the external shell, such that one or more self-healing particles of the plurality of self-healing particles is configured to rupture upon impact to the substrate, to thereby dispense the film-forming material to help repair any damage to the roofing material; and (c) a single coating applied onto the top surface of the substrate having the plurality of self-healing particles embedded therein, to provide a coated substrate, wherein the coating comprises one of an asphaltic coating, a non-asphaltic coating, a polymer-modified asphaltic coating, or a combination thereof, wherein the top surface of the substrate has an average surface coverage amount of the plurality of self-healing particles of between 70% and 100%.

2. The roofing material according to claim 1, wherein the roofing material further includes a plurality of roofing granules applied to a top surface of the coating of the coated substrate.

3. The roofing material according to claim 1, wherein the self-healing particles further comprise one or more additives.

4. The roofing material according to claim 1, wherein the roofing material having the plurality of self-healing particles achieves one of a Class 3 rating or a Class 4 rating for impact resistance, according to UL 2218.

5. The roofing material according to claim 1, wherein the roofing material is one of a roofing shingle, a roofing membrane, and a roofing tile.

6. The roofing material according to claim 1, wherein the roofing material is one of (i) an asphaltic shingle, (ii) a non-asphaltic shingle, and (ii) a polymer-modified asphalt shingle.

7. The roofing material according to claim 1, wherein the roofing material exhibits an improved impact resistance as compared to a roofing material prepared without self-healing particles.

8. The roofing material according to claim 1, wherein the top surface of the substrate has an average surface coverage amount of the plurality of self-healing particles of greater than 75%.

* * * * *